US005173047A

United States Patent [19]

Shefsiek

[11] Patent Number: 5,173,047

[45] Date of Patent: Dec. 22, 1992

[54] SHROUDED RABBLES FOR USE IN ROTARY HEARTH FURNACES

[75] Inventor: Paul K. Shefsiek, Washington, Pa.

[73] Assignee: Salem Furnace Co., Pittsburgh, Pa.

[21] Appl. No.: 755,867

[22] Filed: Sep. 6, 1991

[51] Int. Cl.[5] ..... F27B 9/16; F23G 5/00

[52] U.S. Cl. ..... 432/138; 432/139; 432/124; 110/247

[58] Field of Search ..... 432/138, 139, 235, 242, 432/151

[56] References Cited

U.S. PATENT DOCUMENTS

| | | | |
|---|---|---|---|
| 979,937 | 12/1910 | Edwards . | |
| 1,732,843 | 10/1929 | Halse . | |
| 3,475,286 | 10/1969 | Kemmerer et al. | 202/117 |
| 3,541,603 | 11/1970 | Tsujihata et al. | 266/21 |
| 3,612,497 | 10/1971 | Allred | 263/22 |
| 3,740,184 | 6/1973 | Oleszko | 432/235 |
| 3,788,800 | 1/1974 | Middleton et al. | 432/235 |
| 3,859,172 | 1/1975 | Wilt, Jr. | 202/117 |
| 3,874,644 | 4/1975 | Grimes | 266/20 |
| 3,905,757 | 9/1975 | von Dreusche | 432/18 |
| 3,988,012 | 10/1976 | Jemal | 266/179 |
| 4,149,845 | 4/1979 | Merrill, Jr. | 432/138 |
| 4,215,981 | 8/1980 | von Dreusche | 432/139 |
| 4,702,694 | 10/1987 | Johnson et al. | 432/133 |
| 4,741,693 | 5/1988 | Solano et al. | 432/139 |
| 4,818,222 | 4/1989 | Docherty et al. | 432/138 |
| 4,834,650 | 5/1989 | Docherty et al. | 432/235 |
| 4,842,051 | 6/1989 | Brownlee | 165/93 |
| 5,080,025 | 1/1992 | Nell et al. | 110/247 |

*Primary Examiner*—Henry C. Yuen

*Attorney, Agent, or Firm*—Webb, Burden, Ziesenheim & Webb

[57] ABSTRACT

A shrouded rabble includes a blade having an active face and a backface with a shroud extending from the backface along a lower edge of the blade. The rabble is suspended above a perforated hearth for urging charge materials on the hearth from one location to another in response to relative rotation between the hearth and the rabble. The action of the rabble on the charge materials causes breakdown of the charge materials and accumulation of fines on the perforated hearth. The shroud defines a shroud chamber behind the blade and screens charge materials from the shroud chamber to expose accumulated fines on the perforated hearth. The charge fines thus become fluidized in an upflowing heating gas and exit the shroud chamber through at least one opening in the shroud, facilitating the flow of heating gas through the perforated hearth and into the charge materials. The opening may simply comprise one end of the shroud being open, or it may include a plurality of holes in the shroud itself. Finally, at least one upwardly directed tube may penetrate the shroud to deposit the fines onto a top surface of the charge materials.

18 Claims, 7 Drawing Sheets

SHROUDED RABBLES FOR USE IN ROTARY HEARTH FURNACES

BACKGROUND OF THE INVENTION

1. Field of the Invention

This invention relates to rotary furnaces and, more particularly, to rabbles used therein for moving aggregate materials during thermolytic processing.

2. Description of Prior Art

Sealed rotary furnaces have long been used for drying or pyrolyzing various materials such as coal, coke or other aggregates. In a particular rotary furnace, externally generated hot gases are introduced into a lower furnace chamber and rise through a rotating perforated hearth, thereby heating materials carried on the hearth. For further discussion of this type of furnace, see U.S. Pat. Nos. 4,818,222 and 4,834,650.

In rotary furnaces, a rabble system is typically used to urge materials on the hearth from one location to another in response to relative rotation between the hearth and the rabbles, as disclosed in U.S. Pat. Nos. 3,475,286; 3,612,497; 3,740,184; 3,788,800; 3,859,172; and 4,149,845. The action of the rabbles on the aggregate materials, in addition to thermal or shearing stresses within the aggregate bed, results in breakdown of the materials and accumulation of "fines" on the perforated hearth below the underside of the rabbles. It has been found that accumulation of fines on the hearth causes blockage between the perforations in the hearth and the coarse aggregate materials on the hearth, resulting in an excessive pressure drop through the bed of materials. The build-up of fines around and under the rabbles has been found to extend throughout the hearth, blocking the flow of heating gas and retarding heating rates.

It is therefore an object of the present invention to provide a device for removing accumulated fines from the perforated hearth. It is a further object to relieve the burden of overlying coarse aggregate materials from the accumulated fines, allowing the fines to be lifted off the hearth in the upflowing heating gas. It is a still further object to replace the fines at a location where blockage between the hearth and the aggregate materials is avoided.

SUMMARY OF THE INVENTION

Accordingly, I have invented a shrouded rabble for use in a rotary furnace having an upper furnace chamber and a lower furnace chamber separated by a perforated hearth, with the upper chamber further defined by a roof above the perforated hearth. A heating gas is passed from the lower chamber through the perforated hearth and into the upper chamber, and the rabble is suspended above the perforated hearth for urging a charge material on the hearth from one location to another in response to relative rotation between the hearth and the rabble. The action of the rabbles on the charge materials causes breakdown of the charge materials and accumulation of charge fines on the perforated hearth.

The shrouded rabble includes a blade having an active face, a backface, an upper edge and a lower edge, with means for supporting the blade in a position directly above the perforated hearth. A shroud extends from the backface of the blade adjacent its lower edge substantially along the length of the lower edge. The shroud cooperates with a portion of the backface to define a shroud chamber directly above the perforated hearth, and the shroud screens charge materials from the shroud chamber to expose accumulated charge fines on the perforated hearth. The charge fines become fluidized in the upflowing heating gas, and at least one opening is in fluid communication with the shroud chamber for conducting the fluidized charge fines therefrom. The opening may include a tube which penetrates the shroud and extends upward to carry charge fines from the shroud chamber, depositing them onto a top surface of the charge materials. The opening may also consist of at least one hole in the shroud for conducting charge fines from the shroud chamber into adjacent charge materials.

Preferably, the shroud has an inverted L-shaped profile, including a horizontal leg extending substantially perpendicular to the blade and a vertical leg extending downward from the horizontal leg and substantially parallel to the blade. A first end of the shroud is adjacent a leading edge of the blade, and the first end is enclosed with a second end opposite the first end being open, thus providing the opening for escape of charge fines Furthermore, a plan view of the shroud may resemble a parallelogram so that the first end forms an acute angle with the shroud chamber portion of the backface and the second end forms an obtuse angle with the same.

The means for supporting the rabble blade may include at least one support shaft extending downward from the roof and fixed to the backface of the blade.

Further details and advantages of the present invention will become apparent from the following description in conjunction with the accompanying drawings.

DETAILED DESCRIPTION OF THE PREFERRED EMBODIMENTS

Figure 1:
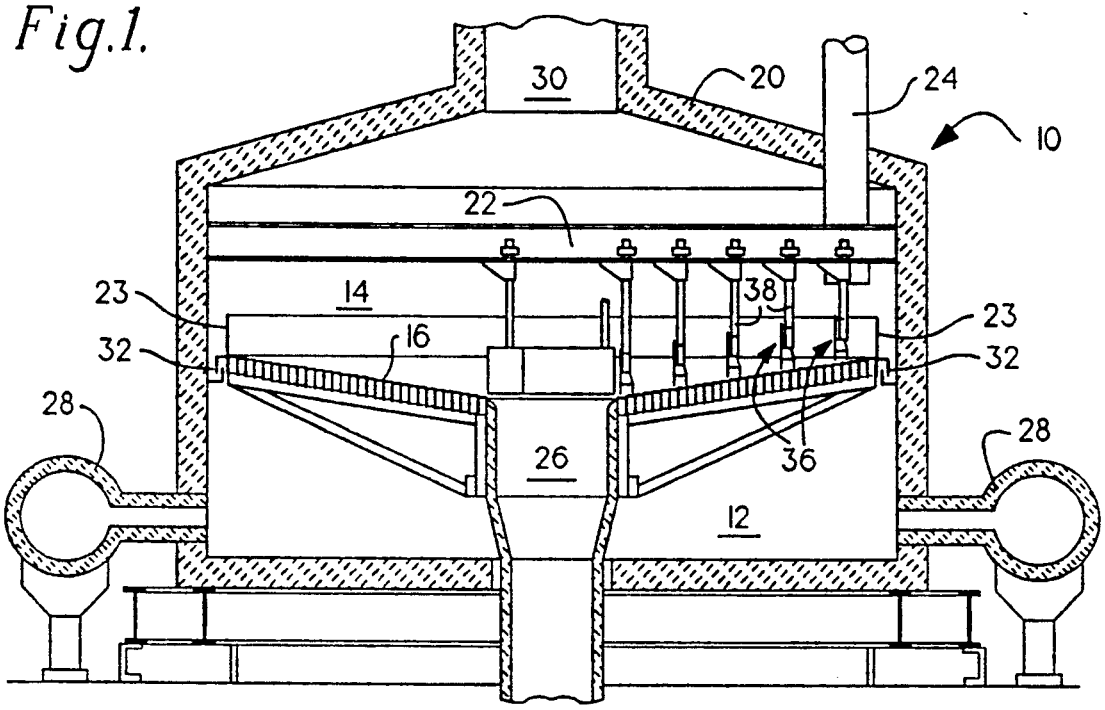
FIG. 1 is a sectional view of a rotary furnace with a perforated hearth and shrouded rabbles in accordance with the present invention.

FIG. 1 shows a sealed rotary hearth furnace 10 having a lower chamber 12 and an upper chamber 14. The chambers 12, 14 are separated by a rotating perforated hearth 16. The upper chamber 14 is further defined by a roof 20, and an I-beam 22 extends transversely through the upper chamber. Charge materials are deposited onto the perforated hearth 16 adjacent its outer rim 23 via an inlet 24, and after processing, the materials are removed through an outlet 26. The hearth 16 is generally conical in shape with outlet 26 located at its center.

A pair of burners 28 are directed into lower chamber 12 for heating gases therein, and the heated gases rise through the perforated hearth 16 and exit through an exhaust 30 in the roof 20. The charge materials, for example, coal, coke and other aggregates, are thus processed by convection heating on the perforated hearth 16. A sand seal 32 surrounds the outer rim 23 of the hearth 16 to ensure that all of the gases pass through the hearth and to seal the furnace interior from the atmosphere.

Figure 2:
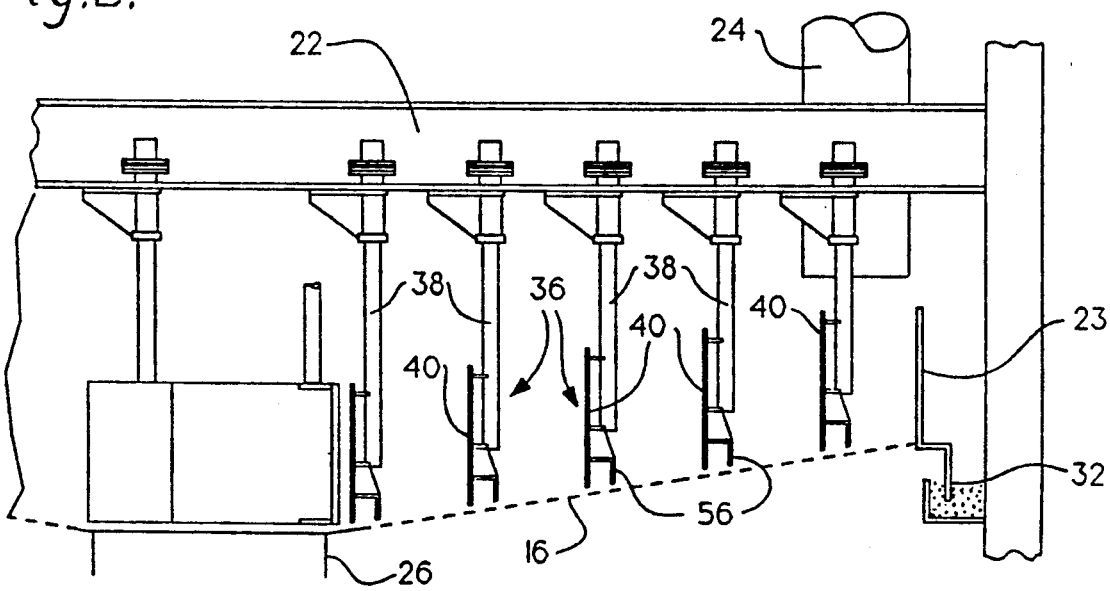
FIG. 2 is an enlarged side view of a portion of the rotary furnace of FIG. 1 showing the shrouded rabbles disposed above the perforated hearth.
Figure 3:
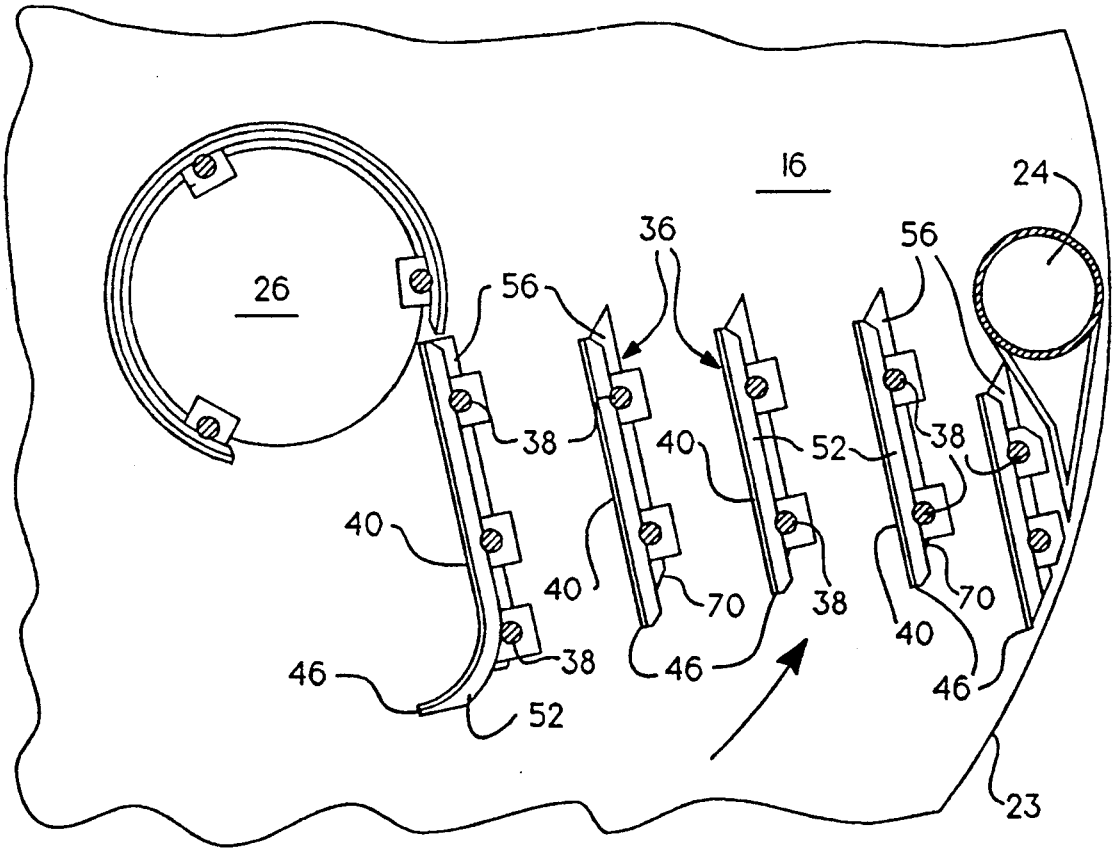
FIG. 3 is a plan view of the shrouded rabbles and perforated hearth of FIG. 2.

Referring to FIGS. 2 and 3, a plurality of rabbles 36 are suspended above the perforated hearth 16 to urge charge materials on the hearth from one location to another in response to relative rotation between the rabbles 36 and the hearth 16. The rabbles 36 are stationary, and each is fixed to I-beam 22 by at least two rabble support shafts 38. Charge materials are deposited onto the hearth 16 at inlet 24 and they rotate counterclockwise with the hearth adjacent outer rim 23 until the hearth brings them into contact with the rabble 36 which is closest to outer rim 23. This rabble urges the charge materials away from outer rim 23 and towards outlet 26. Each rabble thereafter incrementally advances the charge materials until they are ultimately urged by the last rabble 36 into outlet 26. Thus, charge materials may be continuously processed in the rotary furnace 10.

Figure 6:
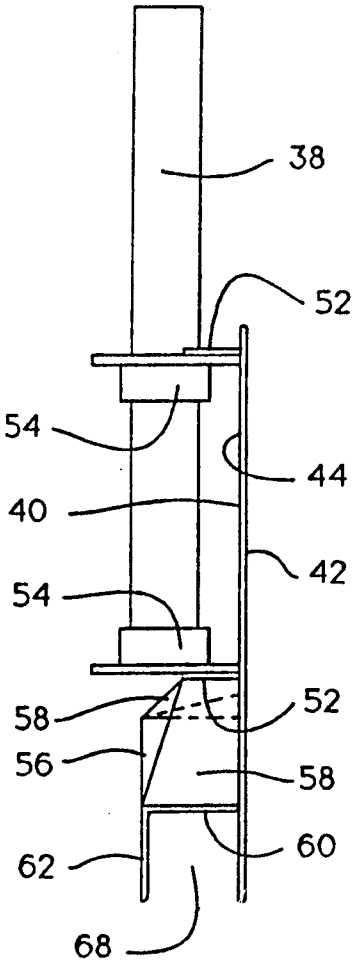
FIG. 6 is an end view of the rabble of FIG. 4.
Figure 4:
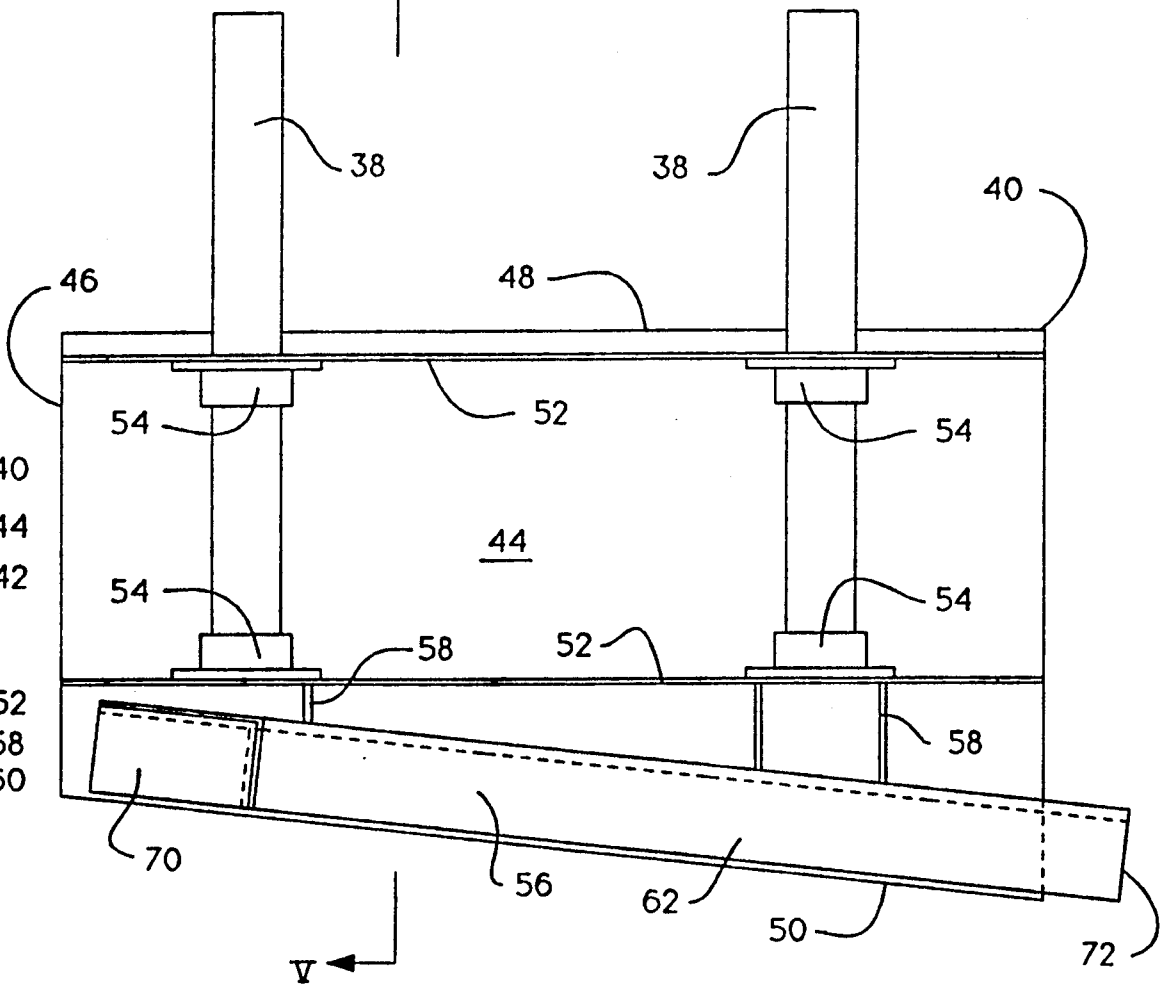
FIG. 4 is a rear view of a first embodiment of a shrouded rabble in accordance with the present invention.
Figure 5:
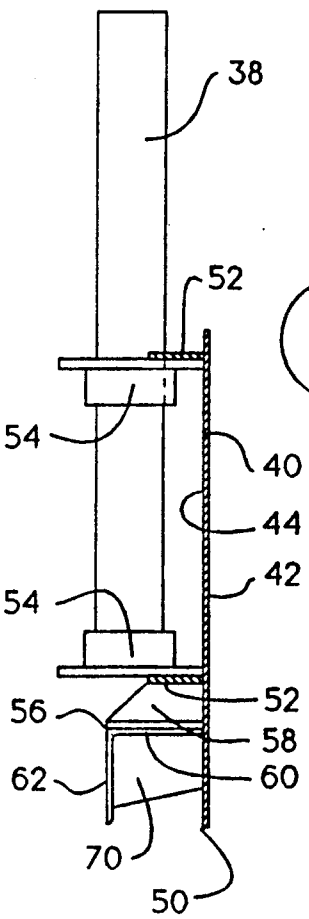
FIG. 5 is a section along lines V—V of FIG. 4.
Figure 9:
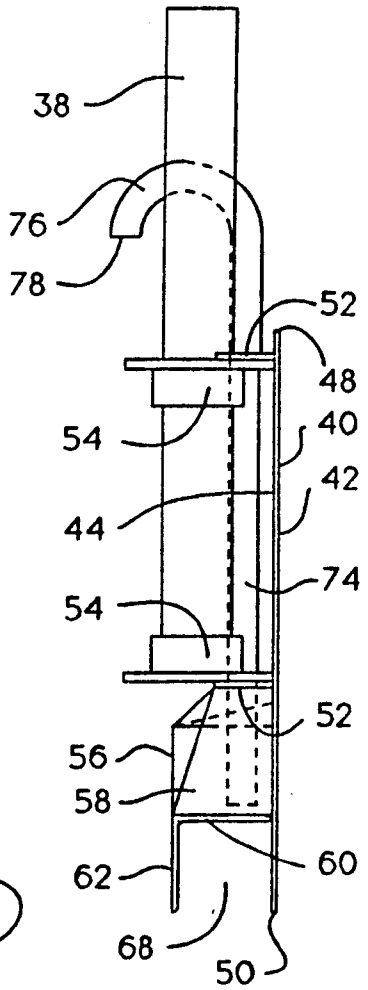
FIG. 9 is an end view of the rabble of FIG. 7.
Figure 7:
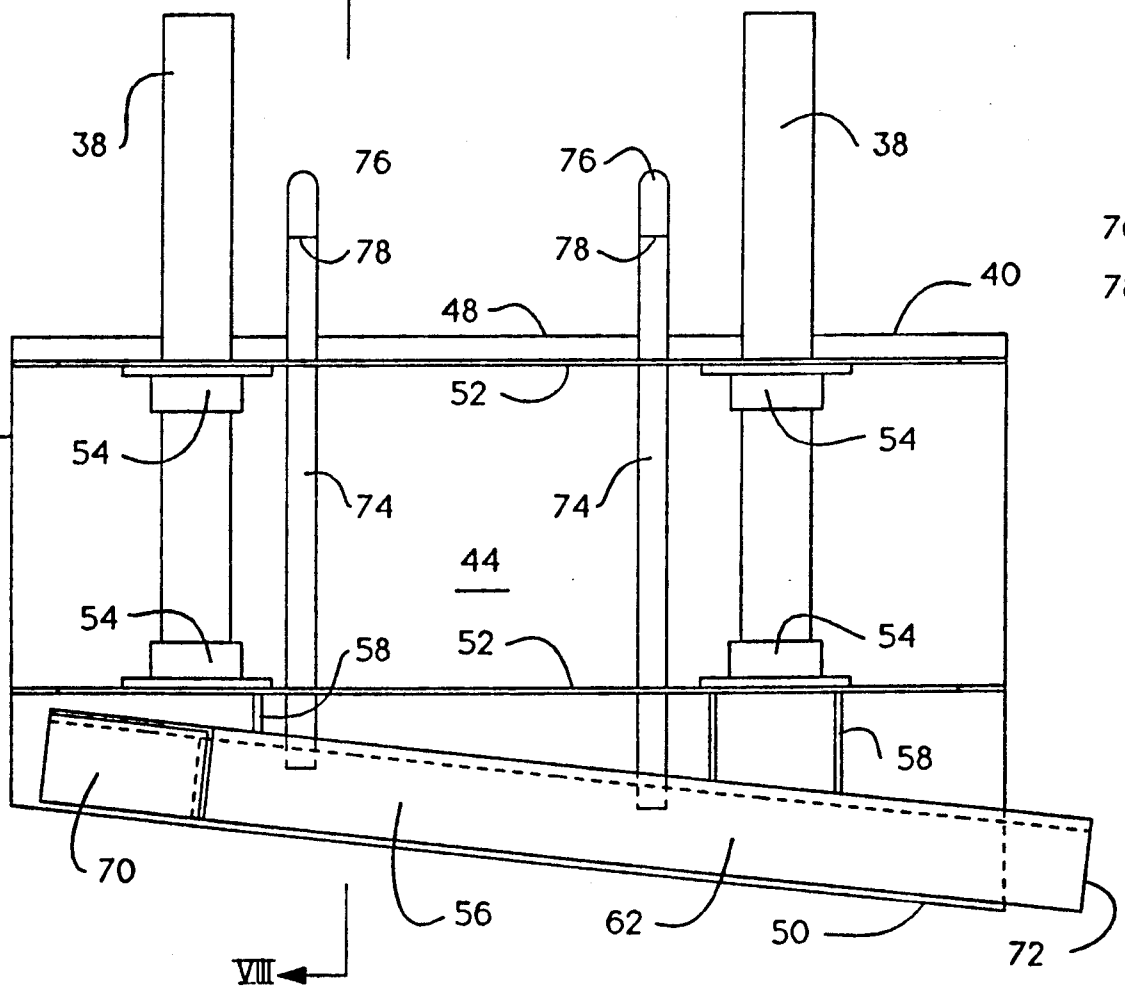
FIG. 7 is a rear view of a second embodiment of a shrouded rabble in accordance with the invention.
Figure 8:
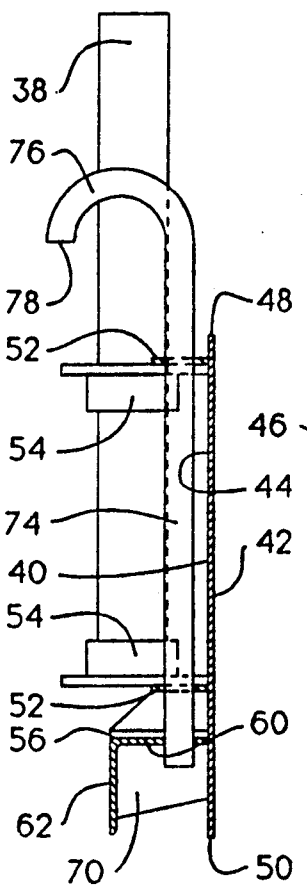
FIG. 8 is a section along lines VIII—VIII of FIG. 7.

Referring to FIGS. 4–6, each rabble 36 consists of a blade 40 having an active face 42, a backface 44, a leading edge 46, an upper edge 48 and a lower edge 50. A pair of fins 52 extend from the backface 44, and the rabble support shafts 38 are fixed to the fins by couplings 54. A shroud 56 extends from the backface 44 of each blade 40 substantially along the length of the lower edge 50 as shown in FIG. 4. The shroud 56 is supported by vertical webs 58 which extend from the lower fin 52 to a horizontal leg 60 of the shroud. A vertical leg 62 extends from an end 64 of the horizontal leg 60 opposite the blade 40, substantially parallel to the blade. The shroud 56 thus has an inverted L-shaped cross-section, and the horizontal and vertical legs 60, 62 cooperate with a portion 66 of backface 44 to define a shroud chamber 68.

Figure 10:
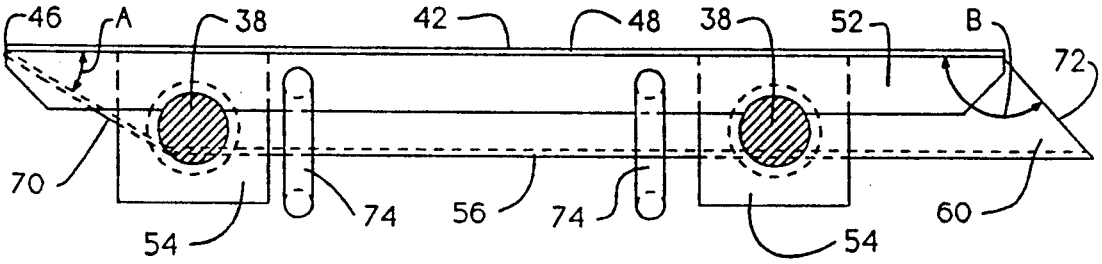
FIG. 10 is a top view of the rabble of FIG. 7.
Figure 11:
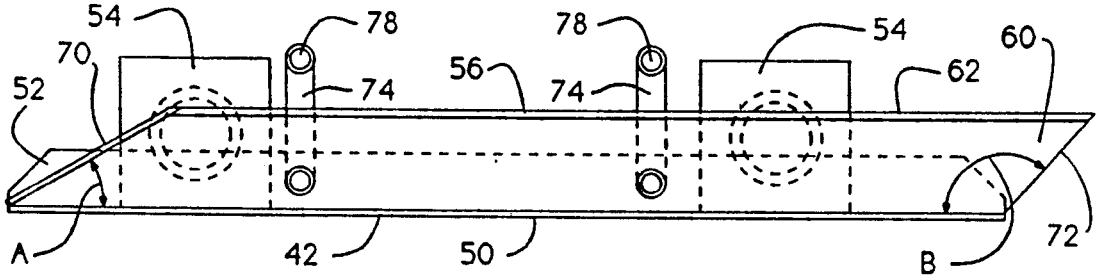
FIG. 11 is a bottom view of the rabble of FIG. 7.
Figure 12:
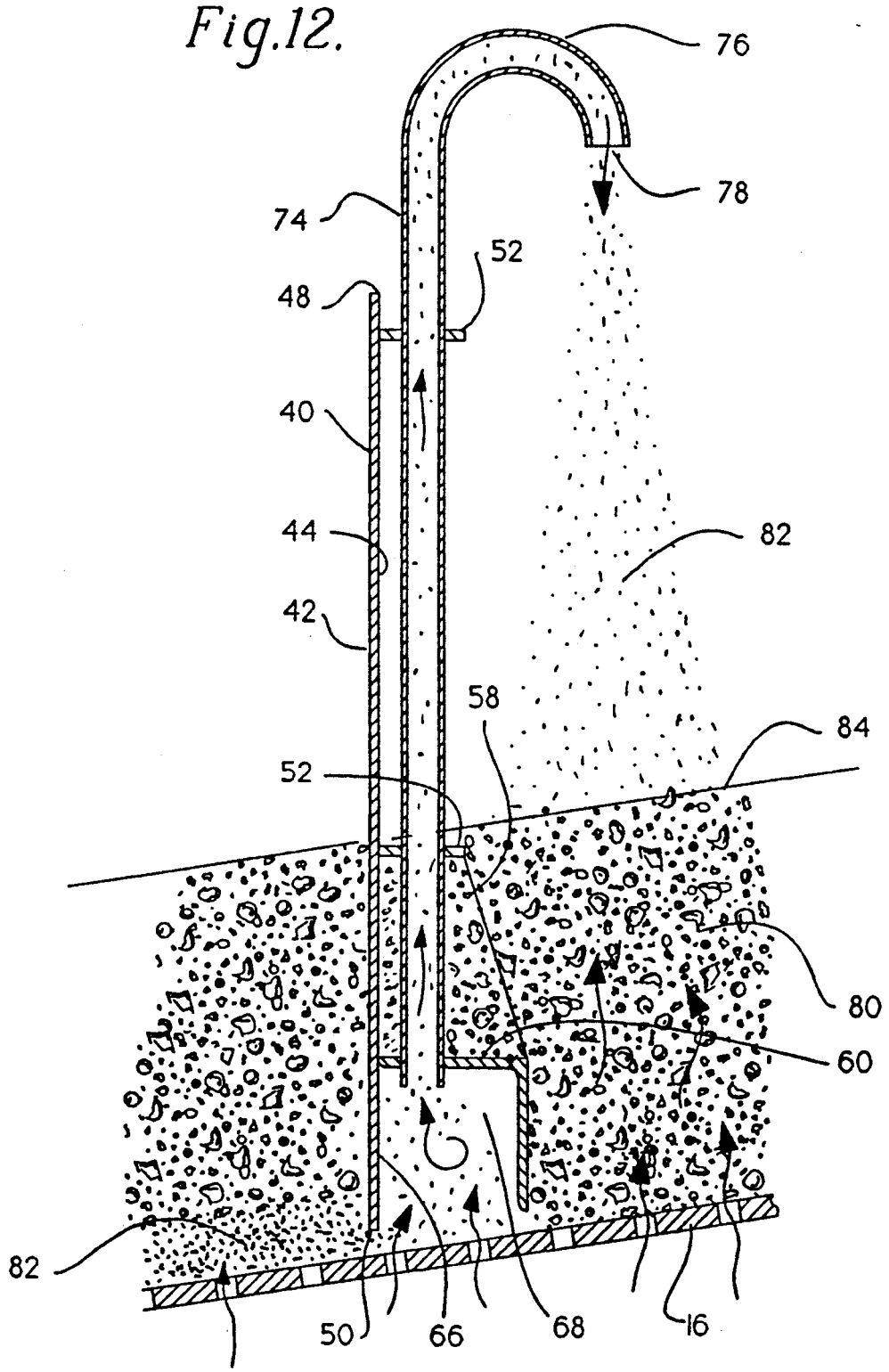
FIG. 12 is a sectional view showing operation of the second embodiment of the shrouded rabble.

An end 70 of the shroud 56 adjacent the leading edge 46 of blade 40 is enclosed while an opposite end 72 remains open. Referring to FIGS. 10 and 11, a plan view of the shroud 56 defines a parallelogram with the closed end 70 forming an acute angle A with the shroud chamber portion 66 of the backface 44, while the open end 72 forms an obtuse angle B with the same.

When charge materials 80 are being processed on perforated hearth 16, they first engage the active face 42 of each blade 40 near its leading edge 46, and then proceed along the length of blade 40 until their course around the perforated hearth 16 has been changed. The action of rabbles 36 against the charge materials, in combination with the thermal stresses which are being applied to the materials, causes physical breakdown of the charge materials 80 and an accumulation of fines 82 on the perforated hearth. The fines 82 generally accumulate between the lower edge 50 of rabble blades 40 and perforated hearth 16 so that the flow of rising gases may become partially blocked. The load of charge materials 80 on top of fines 82 aggravates the problem and prevents the fines 82 from being lifted off the hearth 16 in the upflowing gas.

According to the present invention, the shroud 56 screens charge materials 80 from the shroud chamber 68 and relieves the burden of charge materials over fines 82. The fines 82 are then free to rise from perforated hearth 16, becoming fluidized within shroud chamber 68 in the upflowing heating gas. The enclosed end 70 of the shroud chamber contains fines within the chamber, which might otherwise flow straight through the chamber with the draft caused by rotation of hearth 16. On the other hand, the open end 72 permits the fines to be urged to the next location on hearth 16 by vertical leg 62 so that the fines ultimately pass through outlet 26 and do not build u on hearth 16. The offset shroud better tracks the trail of fines 82 on the hearth 16 behind each blade 40. This ensures that the areas where fines are most heavily accumulated are covered by the shroud.

Referring to FIGS. 7–12, a second embodiment of the shroud 56 includes two vent tubes 74 which penetrate the horizontal leg 60 of the shroud and extend upward above the upper edge 48 of blade 40. Each tube has a bend 76 at its upper end, which directs an outlet 78 downward at a spaced location from backface 44. The vent tubes 74 are further supported by fins 52. The tubes place the shroud chamber 68 in fluid communication with the upper chamber 14 of the rotary hearth furnace 10. Alternatively, they may be placed in communication with an external vacuum or generally connected to the outside of upper chamber 14.

Vent tubes 74 carry the fluidized charge fines out of shroud chamber 68 and above a top surface 84 of the charge materials 80. The fines flow upward through each tube 74, around the bend 76 and downward through outlet 78. The fines thus fall onto top surface 84 where they cannot block flow from the perforated hearth 16 into the charge materials 80.

Figure 13:
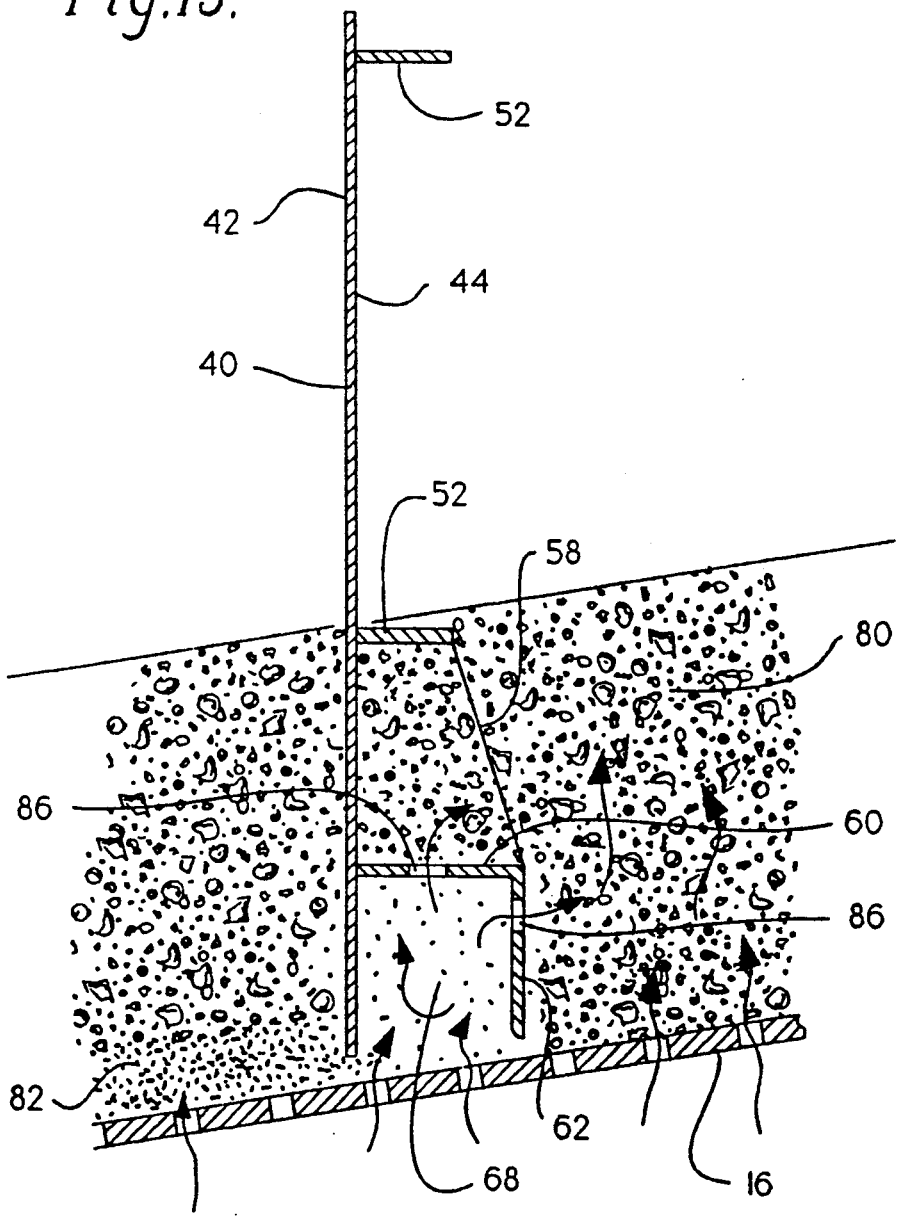
FIG. 13 is a sectional view showing operation of a third embodiment of the shrouded rabble.

Referring to FIG. 13, a third embodiment of the shroud 56 simply contains a plurality of holes 86 in the legs 60, 62 of the shroud for conducting fines 82 from the shroud chamber 68. The fines 82 are deposited into the middle of charge materials 80 where, again, they will not block flow through the perforated hearth 16.

Having described the presently preferred embodiments of the invention, it will be understood that it is not intended to limit the invention except within the scope of the following claims.

I claim:

1. A shrouded rabble for use in a rotary furnace having an upper furnace chamber and a lower furnace chamber, said furnace chambers separated by a perforated hearth, said upper chamber further defined by a roof above said perforated hearth, wherein a heating gas is passed from said lower chamber through said perforated hearth and into said upper chamber, said rabble suspended above the perforated hearth for urging a charge material from one location to another on the perforated hearth in response to relative rotation between the perforated hearth and said rabble, wherein charge fines accumulate on the perforated hearth due to breakdown of charge materials, said rabble comprising:

a blade having an active face, a backface, an upper edge and a lower edge;

means for supporting said blade in a position directly above the perforated hearth;

a shroud extending from the backface of said blade adjacent its lower edge substantially along a length of said lower edge, said shroud cooperating with a portion of said backface to define a shroud chamber directly above the perforated hearth, said shroud screening charge materials from said shroud chamber to expose charge fines on the perforated hearth; and at least one opening in fluid communication with said shroud chamber;

wherein said charge fines become fluidized in the upflowing heating gas and exit the shroud chamber through s id opening.

2. The rabble of claim 1 wherein said shroud has an inverted L-shaped cross-section and includes a horizontal leg extending substantially perpendicular to said blade and a vertical leg extending downward from said horizontal leg and substantially parallel to said blade with a first end of said shroud adjacent a leading edge of said blade and a second end opposite said first end.

3. The rabble of claim 2 wherein the first end of said shroud is enclosed and the second end is open.

4. The rabble of claim 3 wherein the first end of said shroud forms an acute angle with the shroud chamber portion of said backface and the second end forms an obtuse angle with said portion.

5. The rabble of claim 1 wherein said vent opening comprises at least one tube which penetrates said shroud and extends upward to carry charge fines from said shroud chamber, depositing them onto a top surface of the charge materials.

6. The rabble of claim 5 including an inverted bend at an upper end of said tube with a tube outlet thereby spaced from the backface of said blade and directed downward.

7. The rabble of claim wherein said opening comprises at least one hole in said shroud for conducting charge fines from said shroud chamber into adjacent charge materials.

8. The rabble of claim 1 wherein said means for supporting the rabble blade comprises at least one support shaft extending downward from said roof and fixed to the backface of said blade.

9. A shrouded rabble for use in a rotary furnace having an upper furnace chamber and a lower furnace chamber, said furnace chambers separated by a perforated hearth, said upper chamber further defined by a roof above said perforated hearth, wherein a heating gas is passed from said lower chamber through said perforated hearth and into said upper chamber, said rabble suspended above the perforated hearth for urging a charge material from one location to another on the perforated hearth in response to relative rotation between the perforated hearth and said rabble, wherein charge fines accumulate on the perforated hearth due to breakdown of charge materials, said rabble comprising:

a blade having an active face, a backface, an upper edge, a lower edge and a leading edge;

means for supporting said blade in a position directly above the perforated hearth;

a shroud extending from the backface of said blade adjacent its lower edge substantially along a length of said lower edge, said shroud cooperating with a portion of said backface to define a shroud chamber directly above the perforated hearth, said shroud screening charge materials from said shroud chamber to expose charge fines on the perforated hearth;

said shroud having an inverted L-shaped cross-section and including a horizontal leg extending substantially perpendicular to said blade and a vertical leg extending downward from said horizontal leg and substantially parallel to said blade with a first end of said shroud adjacent the leading edge of said blade and a second end opposite said first end; and at least one shroud opening in fluid communication with said shroud chamber for conducting charge fines therefrom;

wherein said charge fines become fluidized in the upflowing heating gas and exit the shroud chamber through said opening.

10. The rabble of claim 9 wherein the first end of said shroud is enclosed and the second end is open.

11. The rabble of claim 10 wherein the first end of said shroud forms an acute angle with the shroud chamber portion of said backface and the second end forms an obtuse angle with said portion.

12. The rabble of claim 9 wherein said opening comprises at least one tube which penetrates said shroud and extends upward to carry charge fines from said shroud chamber, depositing them onto a top surface of the charge materials.

13. The rabble of claim 12 including an inverted bend at an upper end of said tube with a tube outlet thereby spaced from the backface of said blade and directed downward.

14. The rabble of claim 9 wherein said opening comprises at least one hole in said shroud for conducting charge fines from said shroud chamber into adjacent charge materials.

15. The rabble of claim 9 wherein said means for supporting the rabble blade comprises at least one support shaft extending downward from said roof and fixed to the backface of said blade.

16. A shrouded rabble for use in a rotary hearth furnace having an upper furnace chamber and a lower furnace chamber, said furnace chambers separated by a rotating perforated hearth, said upper chamber further defined by a roof above said perforated hearth, wherein a heating gas is passed from said lower chamber through said perforated hearth and into said upper chamber, said rabble suspended above the perforated hearth for urging a charge material from one location to another on the perforated hearth in response to relative rotation between the perforated hearth and said rabble, wherein charge fines accumulate on the perforated hearth due to breakdown of charge materials, said rabble comprising:

a blade having an active face, a backface, an upper edge, a lower edge and a leading edge;

at least one support shaft extending downward from said roof and fixed to the backface of said blade for supporting said blade directly above the perforated hearth;

a shroud extending from the backface of said blade adjacent its lower edge substantially along a length of said lower edge, said shroud cooperating with a portion of said backface to define a shroud chamber directly above the perforated hearth, said shroud screening charge materials from said shroud chamber to expose charge fines on the perforated hearth;

said shroud having an inverted L-shaped cross-section and including a horizontal leg extending substantially perpendicular to said blade and a vertical leg extending downward from said horizontal leg and substantially parallel to said blade, wherein a first end of said shroud adjacent a leading edge of said blade is enclosed and a second end opposite said first end is open, said first end forming an acute angle with the shroud chamber portion of said backface and said second end forming an obtuse angle with said portion;

wherein said charge fines become fluidized in the upflowing heating gas and exit the shroud chamber through said open second end of the shroud.

17. The shrouded rabble of claim 16 including at least one tube which penetrates the horizontal leg of said shroud and extends upward to carry charge fines from said shroud chamber.

18. The shrouded rabble of claim 16 including at least one hole in said shroud for conducting charge fines from said shroud chamber into adjacent charge materials.

* * * * *